United States Patent [19]

Gainer, Jr.

[11] 4,261,099

[45] Apr. 14, 1981

[54] METHOD FOR MAKING MULTI-ELEMENT BRUSHES

[75] Inventor: Robert E. Gainer, Jr., Monroeville, Pa.

[73] Assignee: Westinghouse Electric Corp., Pittsburgh, Pa.

[21] Appl. No.: 61,230

[22] Filed: Jul. 27, 1979

[51] Int. Cl.[3] ..... H01R 43/12

[52] U.S. Cl. ..... 29/872

[58] Field of Search ..... 29/826, 411, 419 R, 29/423, 872; 34/15, 16; 427/350

[56] References Cited

U.S. PATENT DOCUMENTS

| | | | |
|---|---|---|---|
| 535,173 | 3/1895 | Rudd | 34/16 |
| 1,661,844 | 3/1928 | Miller | 427/350 X |
| 2,311,704 | 2/1943 | Simison | 29/411 |
| 2,386,246 | 10/1945 | Mapes | 29/423 X |
| 2,716,684 | 8/1955 | Barnes | 29/826 X |
| 3,540,114 | 11/1970 | Roberts et al. | 29/419 |
| 3,571,901 | 3/1971 | Sara | 29/419 |
| 3,818,588 | 6/1974 | Bates | 29/419 X |
| 3,823,489 | 7/1974 | Boom | 34/15 X |

*Primary Examiner*—Charlie T. Moon
*Assistant Examiner*—C. J. Arbes
*Attorney, Agent, or Firm*—F. J. Baehr, Jr.

[57] ABSTRACT

A method of making electrical brushes from thousands of hair-like fibers comprises wetting the fibers to hold them together in a bundle, placing the bundle in a tube and reducing the opening in the tube to hold the fibers therein.

11 Claims, 7 Drawing Figures

METHOD FOR MAKING MULTI-ELEMENT BRUSHES

BACKGROUND OF THE INVENTION

This invention relates to brushes for dynamoelectric machines and more particularly to a method for making multi-element brushes having thousands of hair-like conductive fibers.

Advanced current collection research is being conducted to improve brush current density from the present level of 1.55 milliamps per square meter (1,000 amps per square inch) to 7.75 milliamps per square meter (5,000 amps per square inch). The main thrust of this research is to achieve very high density current collection systems, which will lead to new compact dynamoelectric machines for high mobility systems application.

Presently when utilizing solid body type brushes, due to their hardness, elastic and plastic deformation, which occurs in both bodies, only 10 to 50 contact points are made between the slipring and the collector surface. One approach to improve the number of contact points is the multi-element brush in which a large number of essentially independent sub-units, the fibers, make contact with the slipring or current collector. The multiplicity of independent contact members insures a multiplicity of contact points.

The problem in fabricating a brush consisting of thousands of metal, metal-plated graphite or carbon fibers generally having a diameter of 8 to 10 microns is joining together one end of the brush in good electrical contact and in having the other end loosely packed for contacting the collector surface. The hair-like fibers are difficult to handle and to fabricate a reproducible brush consistent in fibers per unit area, fiber flexibility and also producing a joint on the other end of low resistance. The initial procedure for producing multi-fiber brushes was to tie a bundle of fibers together and soft solder one end to a piece of copper; this procedure will not produce consistent fiber brushes.

SUMMARY OF THE INVENTION

In general, a method for forming a multi-element electrical brush made up of a multiplicity of conductive fibers, when made in accordance with this invention, comprises the steps of applying a liquid to the fibers, aligning the wet fibers and placing them in a bundle, cutting the wet bundle to a predetermined length, placing the cut wet bundle in a metal tubular member having generally the same length as the cut bundle, removing the liquid from the fibers in the tubular member, reducing the opening in the tubular member to compact the fibers to a predetermined density, and removing a portion of the tubular member from one end freeing one end of the fibers to form the brush.

BRIEF DESCRIPTION OF THE DRAWINGS

The objects and advantages of this invention will become more apparent from reading the following detailed description in connection with the accompanying drawings in which.

DESCRIPTION OF THE PREFERRED EMBODIMENT

Figure 4:
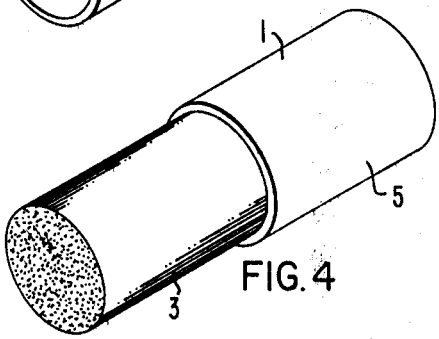
FIG. 4 is a perspective view of a brush made in accordance with this invention.

Referring now to the drawings in detail and in particular to FIG. 4 there is shown a multi-element brush 1 for a dynamoelectric machine (not shown), the brush comprises a plurality of conductive fibers 3 having a diameter in the range of 8 to 10 microns preferably having a graphite or carbon core to provide lubrication and coated with silver or other conductive material. However, it is understood other composite or solid highly conductive hair-like fibers or ribbons may be utilized. One end of the fibers are joined together under a round tubular member 5 formed from a high conductive metal such as copper, while the other end is free to form thousands of collective contact points.

Figure 5:
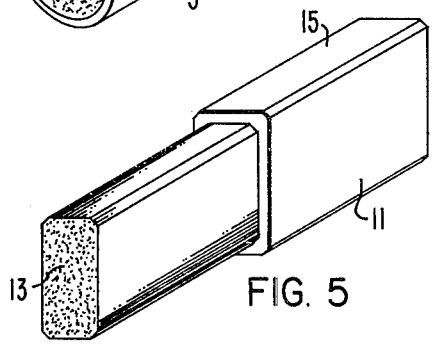
FIG. 5 is a perspective view of an alternate fiber brush made in accordance with this invention.

FIG. 5 shows an alternate brush 11 which comprises a plurality of conductive fibers 13 joined together at one end by a rectangular-shaped tubular member 15 while the other end of the fibers are free to form thousands of collective contact points.

Figure 1:
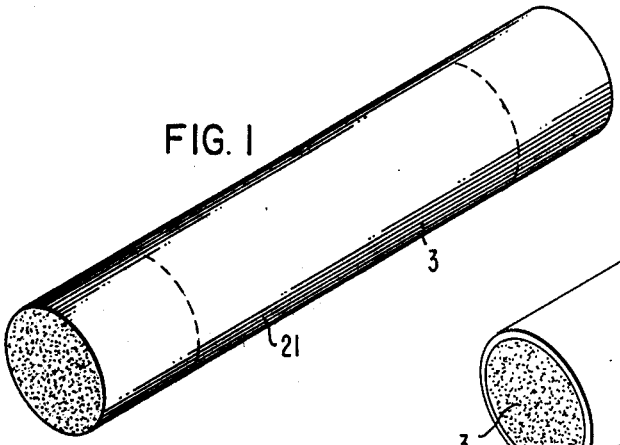
FIG. 1 is a perspective view of a bundle of conductive fibers before they are cut to length.
Figure 3:
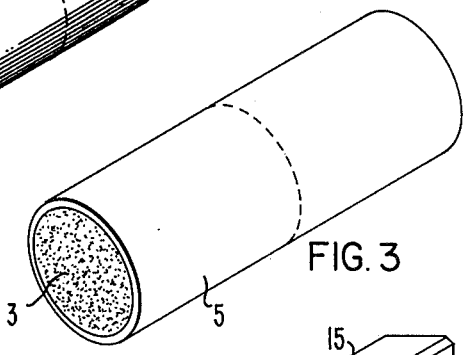
FIG. 3 is a perspective view of the fibers in the tubular member.
Figure 2:
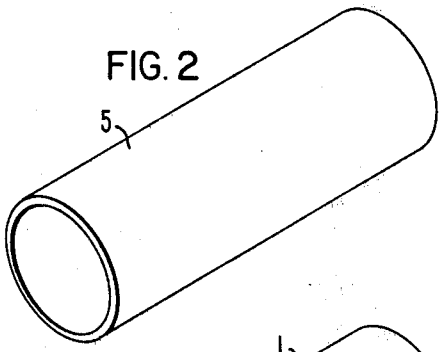
FIG. 2 is a perspective view of a tubular member which receives the bundle of cut conductive fibers.

A method for making brushes 1 and 11 comprises the steps of:

a. wetting the fibers with a liquid such as methanol or other liquid which will hold the hair-like fibers together, not contaminate them, and can be completely removed therefrom;

b. forming a bundle 21 of the wet fibers by aligning the fibers generally parallel to each other as generally shown in FIG. 1;

c. cutting the wet fiber bundle to a predetermined length, the length of the desired brush;

d. preparing a tubular member, made from a material such as highly conductive copper or other highly conductive metals by annealing the tubular member, cleaning it by removing essentially all of the surface oxides, and cutting it to generally the same length as the fiber was cut as shown in FIG. 2;

e. placing the wet bundle of fibers inside the tubular member, as shown in FIG. 3;

f. removing the methanol or other liquid from the tubular member and fibers by blowing it away and/or placing the tubular member and fibers in a low temperature vacuum oven to remove essentially all of the methanol or other liquid;

g. reducing the opening in the tubular member by swaging or spinning or other means to any desired fiber packing density, preferably a density between 75% and 100% will cause a metallic bond in the silver coating the fibers; the reduction of the opening in the tubular member and thus the packing density may vary from 100% density adjacent one end and decreases as the tubular member approaches the free end of the brush;

h. removing the tubular member from a portion of the fiber bundle to free the fibers on one end;

i. heating the tubular material to increase the electrical conductivity.

The method hereinbefore described can be utilized to produce many combination and sizes of brushes, for example, those containing 80,000 to 400,000 fibers in a rectangular, round or any other desired shape. The fibers or ribbons can be metal coated graphite or carbon, metal wires or metal coated with a lubricant.

Figure 7:
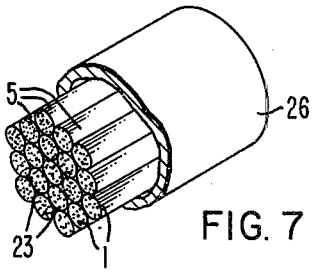
FIG. 7 is a perspective view of still another alternate brush.
Figure 6:
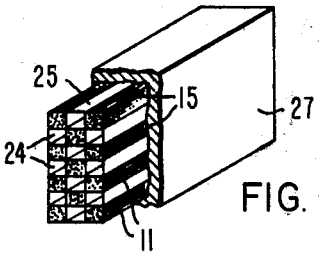
FIG. 6 is a perspective view of another alternate brush.

The method also comprises stacking the brushes 1 or 11 with cooling and/or lubricating ducts 23 and 24 disbursed among the tubular portions 5 or 15 of the brushes 1 or 11. This may be accomplished by placing conduits 25 adjacent the tubular portion 15 as shown in FIG. 6, or arranging the tubular portions 5 so there are voids forming the ducts 24 as shown in FIG. 7. An outer tubular member 25 or 27 of the appropriate cross section is shipped over the tubular portions 5 or 15 and then the opening in the outer tubular member 2 or 27 is reduced by swagging or spinning to clamp the tubular members 5 and 15 firmly in place forming a brush with cooling and/or lubricating ducts disposed therein.

What is claimed is:

1. A method for forming a multi-element electrical brush made up of a multiplicity of conductive fibers, said method comprising the steps of:

applying a liquid to said fibers;

aligning said wet fibers to form a bundle;

cutting said wet bundle to a predetermined length;

cutting a metal tubular member generally to the same predetermined length;

annealing the tubular member;

removing essentially all of the surface oxides from the metal of the tubular member;

placing the cut wet bundle of predetermined length in the metal tubular member of generally the same predetermined length;

removing the liquid from the bundle of fibers in the tubular member;

reducing the opening in the tubular member to compact the fibers at least on one end to a predetermined density;

removing a portion of the tubular member freeing one end of the fibers;

stacking a plurality of tubular members with the compacted fibers therein with ducts dispersed in a stack;

placing the stack in an outer tubular member; and reducing the opening in the outer tubular member to form a unitized fiber brush with ducts disposed therein.

2. A method as set forth in claim 1, wherein the step of aligning the fibers in a bundle comprises aligning fibers coated with a highly conductive metal.

3. The method as set forth in claim 1 wherein the step of aligning the fibers in a bundle comprises aligning fibers coated with silver.

4. A method as set forth in claim 1 wherein the step of aligning the fibers in a bundle comprises aligning graphite or carbon fibers coated with a highly conductive metal.

5. The method as set forth in claim 1, wherein the step of aligning the fibers in a bundle comprises aligning graphite or carbon fibers coated with silver.

6. The method as set forth in claim 1, wherein the step of applying liquid to the fibers comprises applying methanol.

7. The method as set forth in claim 1, wherein the step of removing the liquid comprises blowing it from the tubular member.

8. The method as set forth in claim 7 wherein the step of removing liquid from the bundle further comprises placing the tubular members with the fiber bundle therein in a low temperature vacuum oven.

9. The method as set forth in claim 1, wherein the step of removing liquid from the fibers comprises placing the fiber and tubular member in a low temperature vacuum oven.

10. The method as set forth in claim 1, wherein the step of reducing the opening in the tubular member comprises reducing the opening by swaging.

11. The method as set forth in claim 1, wherein the step of reducing the opening in the tubular member comprises reducing the opening by spinning.

* * * * *